US009060607B1

(12) United States Patent
Canales

(10) Patent No.: US 9,060,607 B1
(45) Date of Patent: Jun. 23, 2015

(54) HANGER BAR FOR RECESSED LIGHT FIXTURE MOUNTING

(71) Applicant: Matthew A. Canales, Dothan, AL (US)

(72) Inventor: Matthew A. Canales, Dothan, AL (US)

(73) Assignee: Cooper Technologies Company, Houston, TX (US)

( * ) Notice: Subject to any disclaimer, the term of this patent is extended or adjusted under 35 U.S.C. 154(b) by 124 days.

(21) Appl. No.: 13/654,166

(22) Filed: Oct. 17, 2012

(51) Int. Cl.
*E04G 25/00* (2006.01)
*A47B 97/00* (2006.01)
*A47F 5/00* (2006.01)

(52) U.S. Cl.
CPC ..... *A47B 97/001* (2013.01); *A47F 5/0006* (2013.01)

(58) Field of Classification Search
CPC ..... F12V 21/04; F21V 21/028; F21V 23/02
USPC ..... 248/200.1, 343, 342, 906, 344; 362/365, 364, 147, 368
See application file for complete search history.

(56) References Cited

U.S. PATENT DOCUMENTS

| | | | |
|---|---|---|---|
| 1,156,885 | A | 10/1915 | Caine |
| 1,350,295 | A | 8/1920 | Champeau |
| 1,622,087 | A | 3/1927 | Calderwood |
| 1,756,361 | A | 4/1930 | Johnson |
| 1,791,480 | A | 2/1931 | Smith et al. |
| 1,821,733 | A | 9/1931 | Thibodeau |
| 2,316,389 | A | 4/1943 | Atkinson |
| 2,518,515 | A | 8/1950 | Austin |
| 2,658,241 | A | 11/1953 | Houghton et al. |
| 2,713,983 | A | 7/1955 | Kay |
| 2,802,933 | A | 8/1957 | Broadwin |
| 2,887,568 | A | 5/1959 | Franck |
| 2,930,564 | A | 3/1960 | Maier |
| 2,933,549 | A | 4/1960 | Antonucci |
| 3,040,172 | A | 6/1962 | Chan |
| 3,099,404 | A | 7/1963 | Kaufman et al. |
| 3,102,306 | A | 9/1963 | Hutchinson |
| 3,104,087 | A | 9/1963 | Budnick et al. |
| 3,154,001 | A | 10/1964 | Zurawski |
| 3,162,413 | A | 12/1964 | Hexdall |
| 3,300,634 | A | 1/1967 | Libreman |
| 3,313,931 | A | 4/1967 | Kugman |
| 3,597,889 | A | 8/1971 | Nigro |
| 3,609,338 | A | 9/1971 | Kripp |
| 3,710,096 | A | 1/1973 | McFarlin |
| 4,022,415 | A | 5/1977 | Roderick et al. |

(Continued)

OTHER PUBLICATIONS

Juno Lighting; Product specification; 6" Deluxe Universal TC Housing; TC2; Feb. 2009.

(Continued)

*Primary Examiner* — Amy Sterling
(74) *Attorney, Agent, or Firm* — King & Spalding LLP

(57) ABSTRACT

A hanger bar for a recessed lighting fixture mounting is disclosed. The hanger bar includes a rail portion having a wall that is in a first plane. The hanger bar further includes a first end portion disposed at a first end of the rail portion and a second end portion disposed at a second end of the rail portion. Each of the first end portion and the second end portion includes a first tab extending from the rail portion in a second plane that is substantially perpendicular to the first plane. Each of the first end portion and the second end portion further includes a second tab extending from the rail portion and a notch that is substantially below the first tab. The second tab extends beyond the first tab, and the notch is partially bounded by an edge of the second tab.

17 Claims, 10 Drawing Sheets

(56) References Cited

U.S. PATENT DOCUMENTS

| | | | | |
|---|---|---|---|---|
| 4,040,589 | A | 8/1977 | McLay | |
| 4,041,657 | A | 8/1977 | Schuplin | |
| 4,086,480 | A | 4/1978 | Lahm | |
| 4,114,327 | A | 9/1978 | Williams | |
| 4,122,762 | A | 10/1978 | Williams | |
| 4,149,693 | A | 4/1979 | LoNigro | |
| 4,165,851 | A | 8/1979 | Bowden et al. | |
| 4,190,355 | A | 2/1980 | Avery et al. | |
| 4,230,900 | A | 10/1980 | Speet | |
| 4,290,098 | A | 9/1981 | Pierson | |
| 4,336,575 | A | 6/1982 | Gilman | |
| 4,388,677 | A | 6/1983 | Druffel | |
| 4,391,428 | A | 7/1983 | Grimes | |
| 4,406,216 | A | 9/1983 | Hott et al. | |
| 4,408,262 | A | 10/1983 | Kusmer | |
| 4,475,147 | A | 10/1984 | Kristofek | |
| 4,511,113 | A | 4/1985 | Druffel et al. | |
| 4,519,019 | A | 5/1985 | Hall | |
| 4,545,000 | A | 10/1985 | Fraley et al. | |
| 4,564,888 | A | 1/1986 | Lewin et al. | |
| 4,566,057 | A | 1/1986 | Druffel | |
| 4,569,003 | A | 2/1986 | Elmer et al. | |
| 4,577,824 | A | 3/1986 | Druffel et al. | |
| 4,646,212 | A | 2/1987 | Florience | |
| 4,670,822 | A | 6/1987 | Baker | |
| 4,723,747 | A | 2/1988 | Karp et al. | |
| 4,729,080 | A | 3/1988 | Fremont et al. | |
| 4,742,440 | A | 5/1988 | Guzzini | |
| 4,754,377 | A | 6/1988 | Wenman | |
| 4,757,967 | A | 7/1988 | Delmore et al. | |
| 4,760,510 | A | 7/1988 | Lahti | |
| 4,760,981 | A | 8/1988 | Hodges | |
| 4,762,162 | A | 8/1988 | Chockrek | |
| 4,796,169 | A | 1/1989 | Shemitz | |
| 4,803,603 | A | 2/1989 | Carson | |
| 4,829,410 | A | 5/1989 | Patel | |
| 4,872,097 | A | 10/1989 | Miller | |
| 4,930,054 | A | 5/1990 | Krebs | |
| 4,972,339 | A | 11/1990 | Gabrius | |
| 4,978,092 | A | 12/1990 | Nattel | |
| 5,029,794 | A | 7/1991 | Wolfe | |
| 5,034,867 | A | 7/1991 | Mayer | |
| 5,044,582 | A | 9/1991 | Walters | |
| 5,045,985 | A * | 9/1991 | Russo et al. | 362/366 |
| 5,057,979 | A | 10/1991 | Carson et al. | |
| 5,073,845 | A | 12/1991 | Aubrey | |
| 5,074,515 | A | 12/1991 | Carter, Jr. | |
| 5,075,828 | A | 12/1991 | Gordin et al. | |
| 5,075,831 | A | 12/1991 | Stringer et al. | |
| 5,130,913 | A | 7/1992 | David | |
| 5,176,345 | A | 1/1993 | Medlin | |
| 5,178,503 | A | 1/1993 | Losada | |
| 5,209,444 | A | 5/1993 | Rinderer | |
| 5,222,800 | A | 6/1993 | Chan et al. | |
| 5,291,381 | A | 3/1994 | Price | |
| 5,316,254 | A | 5/1994 | McCartha | |
| D351,481 | S | 10/1994 | Cole, Jr. | |
| 5,374,812 | A | 12/1994 | Chan et al. | |
| 5,379,199 | A | 1/1995 | Hirshenhorn et al. | |
| 5,386,959 | A | 2/1995 | Laughlin et al. | |
| 5,452,816 | A | 9/1995 | Chan et al. | |
| 5,457,617 | A | 10/1995 | Chan et al. | |
| 5,505,419 | A | 4/1996 | Gabrius | |
| 5,571,256 | A | 11/1996 | Good et al. | |
| 5,581,448 | A | 12/1996 | Harwood | |
| 5,588,737 | A | 12/1996 | Kusmer | |
| 5,595,028 | A | 1/1997 | Handzlik | |
| 5,597,234 | A | 1/1997 | Winkelhake | |
| 5,618,017 | A | 4/1997 | DeBoer | |
| 5,619,263 | A | 4/1997 | Laughlin et al. | |
| 5,623,789 | A | 4/1997 | Kidwell et al. | |
| D384,431 | S | 9/1997 | Bitton | |
| 5,662,413 | A | 9/1997 | Akiyama | |
| 5,662,414 | A | 9/1997 | Jennings et al. | |
| 5,678,799 | A | 10/1997 | Jorgensen et al. | |
| 5,690,423 | A | 11/1997 | Hentz et al. | |
| 5,738,436 | A | 4/1998 | Cummings et al. | |
| 5,746,507 | A | 5/1998 | Lee | |
| 5,758,959 | A | 6/1998 | Sieczkowski | |
| 5,800,051 | A | 9/1998 | Gampe et al. | |
| 5,826,970 | A | 10/1998 | Keller et al. | |
| 5,845,886 | A | 12/1998 | McCormick | |
| 5,857,766 | A | 1/1999 | Sieczkowski | |
| 5,873,556 | A | 2/1999 | Reiker | |
| 5,934,631 | A | 8/1999 | Becker et al. | |
| 5,954,304 | A | 9/1999 | Jorgensen | |
| 5,957,573 | A | 9/1999 | Wedekind et al. | |
| 5,957,574 | A | 9/1999 | Hentz et al. | |
| 6,004,011 | A | 12/1999 | Sieczkowski | |
| 6,030,102 | A | 2/2000 | Gromotka | |
| 6,033,098 | A | 3/2000 | Hentz et al. | |
| 6,076,788 | A | 6/2000 | Akiyama | |
| 6,082,878 | A | 7/2000 | Doubek et al. | |
| 6,085,916 | A | 7/2000 | Kovacevic et al. | |
| 6,105,918 | A | 8/2000 | Gromotka | |
| 6,164,802 | A | 12/2000 | Gromotka | |
| 6,216,992 | B1 | 4/2001 | Bisonaya et al. | |
| 6,231,205 | B1 | 5/2001 | Slesinger et al. | |
| 6,286,265 | B1 | 9/2001 | Rinderer | |
| 6,296,211 | B1 | 10/2001 | Snyder | |
| 6,332,597 | B1 | 12/2001 | Korcz et al. | |
| 6,341,466 | B1 * | 1/2002 | Kehoe et al. | 52/712 |
| 6,345,800 | B1 | 2/2002 | Herst et al. | |
| 6,431,723 | B1 | 8/2002 | Schubert et al. | |
| 6,461,016 | B1 | 10/2002 | Jamison et al. | |
| 6,471,374 | B1 | 10/2002 | Thomas et al. | |
| 6,484,980 | B2 | 11/2002 | Medlin, Sr. et al. | |
| 6,505,960 | B2 | 1/2003 | Schubert et al. | |
| 6,519,791 | B2 | 2/2003 | Randolph | |
| 6,527,406 | B1 | 3/2003 | Slesinger et al. | |
| 6,609,690 | B1 | 8/2003 | Davis | |
| 6,637,705 | B2 | 10/2003 | Sjoblom et al. | |
| 6,688,069 | B2 | 2/2004 | Zadeh | |
| 6,691,968 | B1 | 2/2004 | Tseng | |
| 6,726,347 | B2 | 4/2004 | Wronski | |
| 6,805,916 | B2 | 10/2004 | Cadieu et al. | |
| 7,673,841 | B2 | 3/2010 | Wronski | |
| 7,735,795 | B2 | 6/2010 | Wronski | |
| 7,784,754 | B2 | 8/2010 | Nevers et al. | |
| 7,810,775 | B2 | 10/2010 | Dal Ponte et al. | |
| 7,832,889 | B1 | 11/2010 | Cogliano | |
| 7,896,529 | B2 | 3/2011 | Wronski | |
| 8,038,113 | B2 | 10/2011 | Fryzek et al. | |
| 8,177,176 | B2 | 5/2012 | Nguyen et al. | |
| 8,240,630 | B2 | 8/2012 | Wronski | |
| 8,615,947 | B2 * | 12/2013 | Underkofler et al. | 52/506.06 |
| 8,622,361 | B2 | 1/2014 | Wronski | |
| 2005/0183344 | A1 | 8/2005 | Ziobro et al. | |
| 2005/0230589 | A1 | 10/2005 | Wronski | |
| 2005/0247842 | A1 | 11/2005 | Wronski | |
| 2007/0012847 | A1 | 1/2007 | Tai | |
| 2007/0075206 | A1 * | 4/2007 | Wright et al. | 248/343 |
| 2007/0261881 | A1 | 11/2007 | Wronski | |

OTHER PUBLICATIONS

Juno Lighting; Product specification; 6" Vertical IC Compact Fluorescent Housing; ICPL618E; Aug. 2012.

Philips Lightolier; Product specification; Lytening LED; Oct. 2012.

Progress Lighting; Product specification; 5" Shallow Housing IC, Non-IC & Air-Tight; Nov. 2001.

Progress Lighting; Product specification; 6" Housing IC, Non-IC & Air-Tight; Nov. 2013.

Progress Lighting; Product specification; 6" Housing IC, Non-IC & Air-Tight w/ Quick Connects; Nov. 2013.

Nora Lighting; Product specification; NHRIC-504QAT; 5" IC Air-Tight Line Voltage Remodel Hous-ing; Jan. 2, 2002.

WAC Lighting; Product specification; R-602D-N-ICA; 6" Line Voltage New Construction Housing 120V-IC Rated—Airtight Ready; Apr. 2014.

Prescolite; LiteBox-Light Commercial and Residential Downlights; Catalog; Jan. 2009.

Prescolite; LiteBox 6"; Product specification; New Construction DBXMRI; Mar. 22, 2011.

(56) References Cited

OTHER PUBLICATIONS

Lithonia Lighting; Residential Recessed Downlighting Guide; Feb. 2014.
Halo Lighting "Edison Recessed Lighting" Cooper Industries No. ADV 693025 Jan. 1984.
"Edison Lighting" ET 7001 P Cooper Industries 694917 Sep. 1989.
"Edison Lighting" ET 7070 ET 7071 ET7301 ET7401 ET 7410 Cooper Industries 694979 Dec. 1987.
Sears Owner's Manual Model No. 9 89575 694954 Oct. 1987.
Halo H-7T H-27T H-71CT H274 H275 Bar Hanger Installation Instruction 695876 Jun. 1989.
Halo H& Housing with Improved Plaster Frame Cooper Industries 692601 Jul. 1981.
Robert O. Parmley, P.E.; Standard Handbook of Fastening and Joining, Second Edition; McGraw-Hill Publishing; pp. 8-29 to 8-31, 1989.

* cited by examiner

HANGER BAR FOR RECESSED LIGHT FIXTURE MOUNTING

TECHNICAL FIELD

This disclosure generally relates to support for mounting a lighting fixture in a suspension ceiling and, more particularly, to a hanger bar for mounting a recessed light fixture.

BACKGROUND

A lighting device ("luminaire") is a device for producing, controlling, and distributing light. A luminaire, which is also referred to as a lighting fixture, is typically a complete lighting unit consisting of one or more lamps, socket, and optical devices for distributing light. A recessed downlight is an example of a luminaire. For example, a recessed downlight may typically be mounted behind a ceiling wall that has an opening to provide light on an area below the recessed downlight.

Various support systems have been employed to support recessed luminaires. For example, recessed lighting devices are often suspended between support members such as joists and T-bar structures. The recessed lighting devices may be supported by hanger bars that extend between parallel support members. A hanger bar that is easy to install may save time and expense relative to hanger bars that require too many installation steps.

SUMMARY

In a particular embodiment, a hanger bar for a recessed lighting fixture mounting is disclosed. The hanger bar includes a rail portion having a wall that is in a first plane. The hanger bar further includes a first end portion disposed at a first end of the rail portion and a second end portion disposed at a second end of the rail portion. Each of the first end portion and the second end portion includes a first tab extending from the rail portion in a second plane that is substantially perpendicular to the first plane. Each of the first end portion and the second end portion further includes a second tab extending from the rail portion and a notch that is substantially below the first tab. The second tab extends beyond the first tab, and the notch is partially bounded by an edge of the second tab.

In another particular embodiment, a hanger bar assembly includes a first hanger bar, a second hanger bar, and a lighting fixture supported by the first hanger bar and the second hanger bar. Each of the first hanger bar and the second hanger bar includes a rail portion that has a wall in a first plane, a first end portion disposed at a first end of the rail portion, and a second end portion disposed at a second end of the rail portion. Each of the first end portion and the second end portion includes a first tab extending from the rail portion in a second plane that is substantially perpendicular to the first plane and a second tab extending from the rail portion. The second tab extends beyond the first tab. Each of the first end portion and the second end portion further includes a notch that is substantially below the first tab, where the notch is partially bounded by an edge of the second tab.

In another particular embodiment, an unshaped hanger bar includes a rail portion having a wall in a vertical plane, a first end portion at a first end of the rail portion, and a second end portion at a second end of the rail portion. Each of the first end portion and the second end portion includes a first bendable tab extending from the rail portion in substantially the vertical plane and a second bendable tab extending from the rail portion in substantially the vertical plane. The first tab of the first end portion is positioned between a first edge of the rail portion and an edge of the second tab of the first end portion. The first tab of the second end portion is positioned between a second edge of the rail portion and an edge of the second tab of the second end portion.

These and other aspects, objects, features, and embodiments will be apparent from the following description and the claims.

BRIEF DESCRIPTION OF THE DRAWINGS

Various aspects of the embodiments will now be described with reference to the following figures in which the same reference numerals are used to designate corresponding parts throughout each of the several views.

DETAILED DESCRIPTION OF THE EMBODIMENTS

Figure 1:
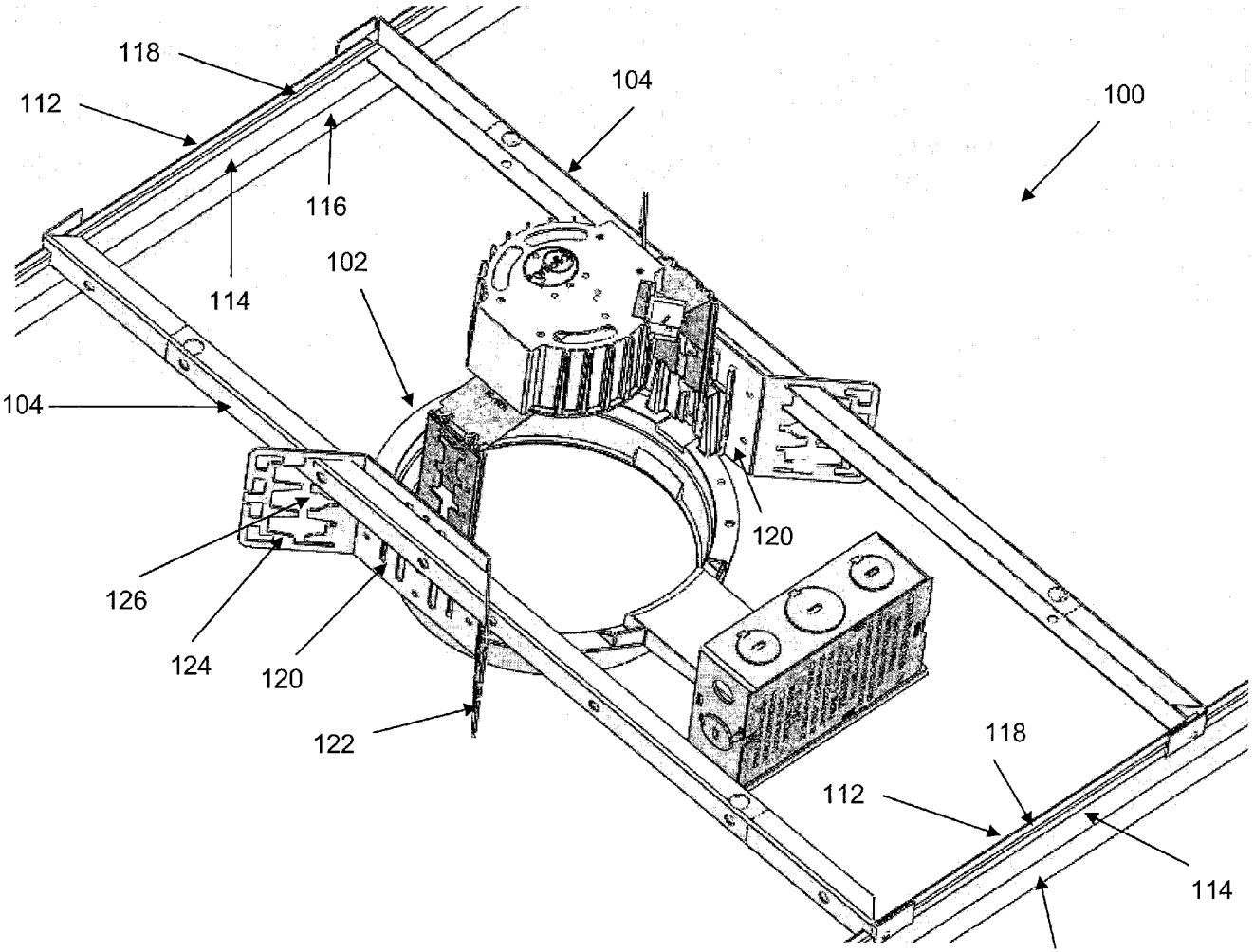
FIG. 1 is an exemplary structure that includes a recessed lighting fixture installed between a pair of spaced hanger bars.

FIG. 1 illustrates an exemplary structure 100 that includes a recessed lighting fixture 102 installed between a pair of spaced hanger bars 104. Each hanger bar 104 is attached at each end to horizontal parallel support members, such as suspended ceiling inverted T-bars 112. The T-bars 112 may be spaced from each other a particular distance that can accommodate the lighting fixture 102 between them. For example, the T-bars 112 may be spaced approximately 14 inches, 16 inches, 19 inches, or 24 inches from each other.

Each T-bar 112 has a web 114, a flange 116, and an enlarged edge 118. The flange 116 of each T-bar 112 extends out on two sides of the web 114 at the bottom end of the inverted T-bar 116. Similarly, the enlarged edge 118 extends out on two sides of the web 114 at the top end of the inverted T-bar 112.

The structure 100 also includes hanger bar receivers 120. The hanger bar receivers 120 are used to secure the lighting fixture 102 to the hanger bars 104. Each hanger bar receiver 120 has flanges 122, 124 that extend at an angle from a portion of each hanger bar receiver 120 that is between the flanges 122, 124. Each flange 122, 124 includes an opening 126 for receiving the hanger bar 104.

Although a recessed downlight is illustrated in FIG. 1, the hanger bars 104 may be used with a variety of other recessed and non-recessed lighting fixture as well as other devices. Further, although FIG. 1 illustrates the hanger bars 104 attached to inverted T-bars 112, in other embodiments, the hanger bars 104 may be attached to other types of support members. The hanger bars 104 may also be attached to support members that are neither horizontal nor parallel. Additionally, the hanger bars 104 may be used with a variety of receivers that are different from the hanger bar receivers 120.

Figure 2:
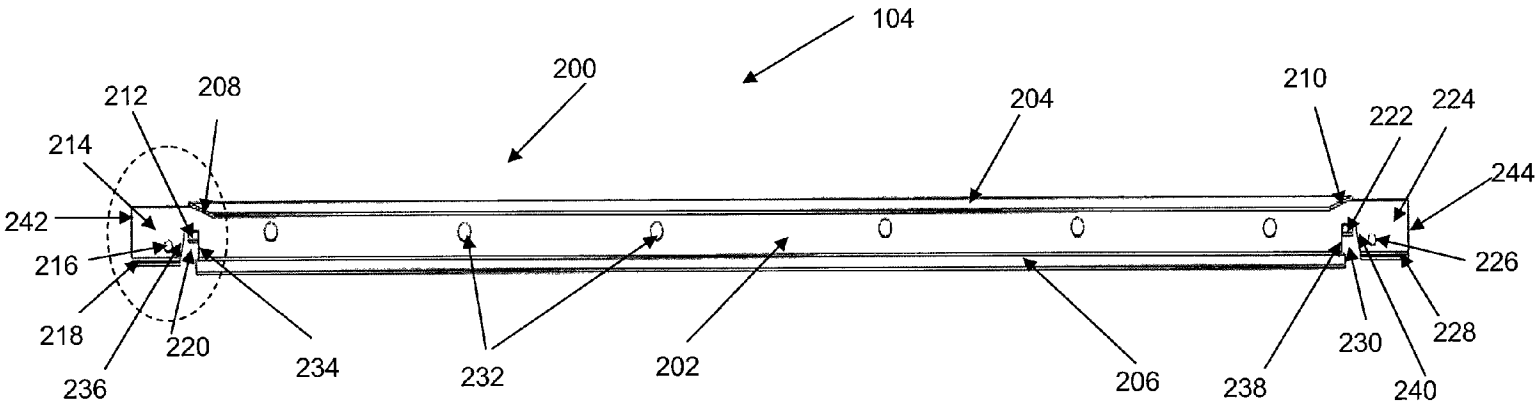
FIG. 2 is an illustrative frontal view of an exemplary hanger bar including a first tab and a second tab at each end of the hanger bar.

FIG. 2 is an illustrative frontal view of the hanger bar 104. The hanger bar 104 has a rail portion that includes a wall 202, a top flange 204, and a bottom flange 206. The wall 202 includes multiple apertures 232. For example, the apertures 232 may be used to align hanger bars 104 that are spaced across support members. The top flange 204 extends substantially perpendicular to the wall 202. The top flange 204 also has a first end 208 and a second end 210 that each have a chamfered corner. For example, each of the first end 208 and the second end 210 may be chamfered at a 45-degree angle relative to the longitudinal axis of the wall 202 of the rail portion. The first end 208 and the second end 210 may be chamfered at angles than other 45 degrees. Further, techniques other than chamfering may be used to achieve a desired angle of the first end 208 and the second end 210 relative to the longitudinal axis of the wall 202 of the rail portion.

Each hanger bar 104 also includes a first end portion that includes a first tab 212 and a second tab 214. The first tab 212 extends out in a horizontal plane from the wall 202 that is in a vertical plane as illustrated in FIG. 2. The first tab 212 is positioned between a first edge 234 of the rail portion and an edge 236 of the second tab 214. The second tab 214 extends beyond the first tab 212 and extends out from the rail portion in substantially the same vertical plane as the wall 202 of the rail portion.

The second tab 214 includes an aperture 216 and a flange 218 extending from a lower edge of the second tab 214. To secure the hanger bar 104 to a support member, such as the inverted T-bars 112 of FIG. 1, the second tab 214 may be bent or folded into a position against the support member as described below with respect to FIGS. 5-7. The aperture 216 may receive a fastener that can secure the second tab 214 to a support member, such as the inverted T-bars 112 of FIG. 1, after the second tab 214 is bent as described below with respect to FIG. 5. For example, the aperture 216 may receive a screw, a nail, or any other fastener that may reasonably be used to secure the second tab 214 to a support member, such as the inverted T-bars 112 of FIG. 1.

Each hanger bar 104 also includes a second end portion that includes a first tab 222 and a second tab 224. The first tab 222 extends out in a horizontal plane from the wall 202 that is in a vertical plane as illustrated in FIG. 2. The first tab 222 is positioned between a second edge 238 of the rail portion and an edge 240 of the second tab 224. The second tab 224 extends beyond the first tab 222 and extends out from the rail portion in substantially the same vertical plane as the wall 202 of the rail portion. In alternate embodiments, the first tabs may be located in alternate positions along the rail portion. For example, the first tabs may fold down from the top flange.

The second tab 224 includes an aperture 226 and a flange 228 extending from a lower edge of the second tab 224. To secure the hanger bar 104 to a support member, such as the inverted T-bars 112 of FIG. 1, the second tab 224 may be bent or folded into a position against the support member as described below with respect to FIGS. 5-7. The aperture 226 may receive a fastener that can secure the second tab 214 to a support member, such as the inverted T-bars 112 of FIG. 1, after the second tab 224 is bent as described below with respect to FIG. 5. For example, the aperture 226 may receive a screw, a nail, or any other fastener that may reasonably be used to secure the second tab 224 to a support member. In alternate embodiments, the second tabs may take other forms, for example, and may not include an aperture or a flange.

Each hanger bar 104 includes a first notch 220 and a second notch 230. The first notch 220 may be partially bounded by the first edge 234 of the rail portion and the edge 236 of the second tab 214. The second notch 230 may be partially bounded by the second edge 238 of the rail portion and the edge 240 of the second tab 224. As shown in FIG. 2, the first notch 220 is partially below the first tab 212 of the first end portion of each hanger bar 104. Similarly, the second notch 230 is partially below the first tab 222 of the second end portion of each hanger bar 104. In alternate embodiments, the first notch and second notch may be located in other positions along the rail portion. For example, the first and second notch may not be aligned with the first tabs.

In a particular embodiment, the hanger bar 104 has a longitudinal length of approximately 26.5 inches from a first end 242 to a second end 244. The top flange 204 may have a longitudinal length of 24 inches, and the bottom flange 206 may have a longitudinal length of approximately 23.87 inches. In other embodiments, the hanger bars 104 may have dimensions consistent with common spacing between inverted T-bars 112. The hanger bar 104 may be fabricated from any suitable material including, but not limited to, aluminum, steel, polymers, and metal alloys.

Although FIG. 2 illustrates the wall 202 and the second tab 214 in the same vertical plane, in other embodiments, the second tab 214 may extend out from the rail portion in a plane other than the vertical plane of the wall 202. For example, in other embodiments, the second tab 214 may be slightly angled from the position of the second tab 214 shown in FIG. 2. Further, in other embodiments, the first tab 212 may be in a plane that is slightly different from the horizontal plane. For example, the first tab 212 may be slightly angled from the position of the second tab 214 shown in FIG. 2. It should also be appreciated by those skilled in the art that the hanger bar 104 shown in FIG. 2 may have other orientations with corresponding changes in the plane of, for example, the wall 202, the first tab 212, and the second tab 214.

Figure 3:
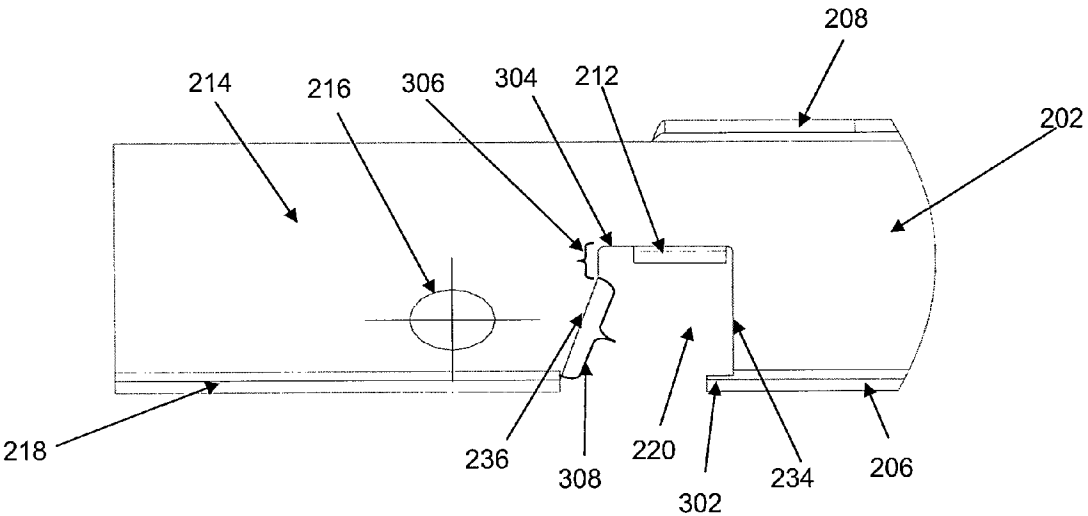
FIG. 3 is a close-up view of a portion of the hanger bar of FIG. 2.

FIG. 3 illustrates a close-up view of a portion of each hanger bar 104 shown bounded by the dotted circle in FIG. 2. As shown in FIG. 3, the first tab 212 is positioned between the first edge 234 of the wall 202 of the rail portion and the edge 236 of the second tab 214. The first tab 212 extends out horizontally from the edge 304 of the wall 202. The first tab 212 is positioned between the first edge 234 of the wall 202 and the edge 236 of the second tab 214.

The second tab 214 extends out sideways from the rail portion in substantially the same plane as the wall 202. The edge 236 of the second tab 214 has a first section 306 that is substantially perpendicular to the edge 304 of the rail portion. The edge 236 of the second tab 214 also has a second section 308 that is angled with respect to the first section 306. In a particular embodiment, the second section 308 of the edge 236 may have a 15-degree angle with respect to a vertical axis along the first section 306 of the edge 236. In other embodiments, the second section 308 of the may be angled greater than or less than 15 degrees from the vertical axis along the first section 306 of the edge 236.

The second tab 214 includes the aperture 216 and the flange 218. The aperture 216 and the flange 218 may help secure the hanger bar 104 to the inverted T-bar 112 shown in FIG. 1. For example, after the second tab 214 is bent into a position against the enlarged edge 118 of the inverted T-bar 112, a fastener inserted in the aperture 216 may be used to secure the second tab 214 to the inverted T-bar 112 of FIG. 1. When the second tab 214 is bent into the position against the enlarged edge 118, the flange 218 may fit under the enlarged edge 118 on one side of the inverted T-bar 112 and help secure the hanger bar 104 to the inverted T-bar 112.

In addition, the bottom flange 206 extending from a bottom edge of the wall 202 may help secure the hanger bar 104 to the inverted T-bar 112. For example, the bottom flange 206 may include a lip 302 that protrudes into the notch 220. The lip 302 may fit under the enlarged edge 118 of the inverted T-bar 112 to help secure the hanger bar 104 to the inverted T-bar 112. The lip 302 and the flange 218 may fit under the enlarged edge 118 on opposite sides of the web 114 of the inverted T-bar 112.

As shown in FIG. 3, the notch 220 is partially below the first tab 212 and partially below the edge 304 of the wall 202. The notch 220 is also partially bounded by the first edge 234 of the wall 202 and the edge 236 of the second tab 214. The notch 220 is sized such that the enlarged edge 118 of the inverted T-bar 112 of FIG. 1 can fit in the notch enabling the primary tab 212 to rest on a top surface of the enlarged edge 118.

Figure 4:
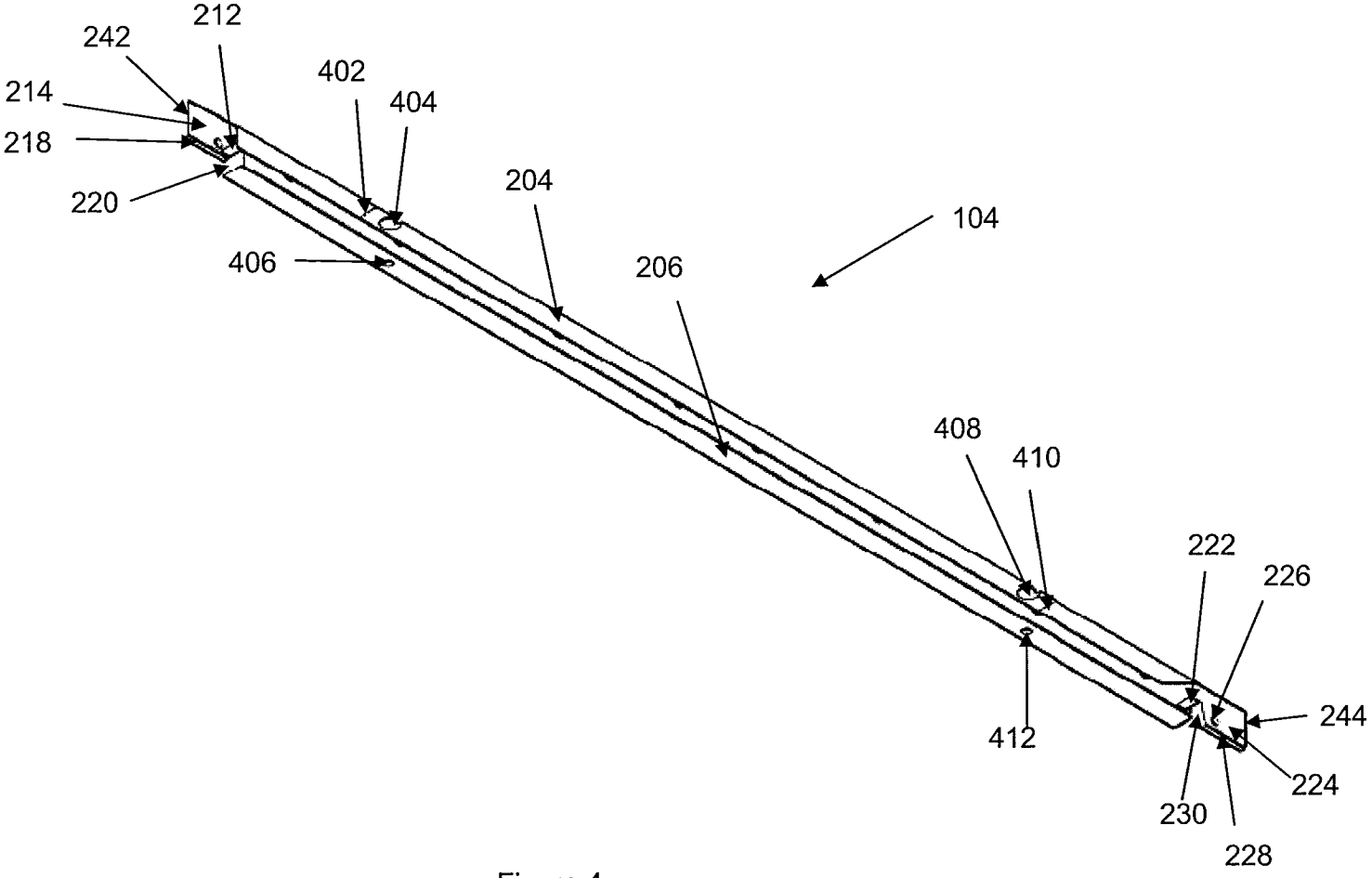
FIG. 4 is an isometric view of the hanger bar of FIG. 2.

FIG. 4 is an isometric view of the hanger bar 104 of FIG. 2. As described above with respect to FIG. 2, the hanger bar 104 includes the top flange 204 and the bottom flange 206. The hanger bar 104 may also include a first score line 402 and a second score line 410 on the top flange 204. The first score line 402 is closer to the first end 242 of the hanger bar 104, and the second score line 410 is closer to the second end 244 of the hanger bar 104. The hanger bar 104 may be broken or cut along the score lines 402, 410 to shorten the length of the hanger bar 104. For example, hanger bar 104 may need to be shortened for use with support members that are spaced closer than the distance between the notches 220 and 230, as described below with respect to FIGS. 9 and 10.

The score lines 402, 410 may be spaced from each other such that the hanger bar 104 can be shortened for use with support members that have widely common spacing between them. For example, the support members may be spaced approximately 14 inches, 16 inches, or 19 inches from each other. In a particular embodiment, the first score line 402 is approximately 4.75 inches from the first end 242 of the hanger bar 104, and the second score line 410 is approximately 4.75 inches from the second end 244 of the hanger bar 104. In other embodiments, the score lines 402, 404 may be closer or farther from the respective end of the hanger bar 104.

Although the score lines 402, 410 are shown on the top flange 204, the score lines 402, 410 may extend to the wall 202 and to the bottom flange 206. Further, although only two score lines are shown in FIG. 4, in other embodiments, the hanger bar 104 may include fewer than two score lines or more than two score lines. For example, the hanger bar 104 may include four score lines with two of the score lines closer to the first end 242 of the hanger bar 104 and the other two score lines closer to the second end 244 of the hanger bar 104.

As shown in FIG. 4, the top flange 204 includes a first aperture 404 and a second aperture 408. The bottom flange 206 includes a first aperture 406 and a second aperture 412. The first aperture 404 of the top flange 204 and the first aperture 406 of the bottom flange 206 are relatively close to the first end 242 of the hanger bar 104. The first aperture 404 of the top flange 204 is positioned such that the first score line 402 is between the first end 242 and the first aperture 404. The first aperture 404 of the top flange 204 may be positioned substantially directly above the first aperture 406 of the bottom flange. For example, the center of the first aperture 404 and the center of the first aperture 406 may be substantially aligned. The first aperture 404 of the top flange 204 may allow at least a portion of a tool, such as a drill or a screw driver, to pass through the first aperture 404 of the top flange 204 to fasten a fastener through the first aperture 406 of the bottom flange 206.

Similarly, the second aperture 408 of the top flange 204 and the second aperture 412 of the bottom flange 206 are relatively close to the second end 244 of the hanger bar 104. The second aperture 408 of the top flange 204 is positioned such that the second score line 410 is between the second end 244 and the second aperture 408. The second aperture 408 of the top flange 204 may be positioned substantially directly above the second aperture 412 of the bottom flange. For example, the second aperture 408 of the top flange 204 may allow at least a portion of a tool, such as a drill or a screw driver, to pass through the second aperture 408 of the top flange 204 to fasten a fastener through the second aperture 412 of the bottom flange 206.

In a particular embodiment, the first aperture 404 of the top flange 204 and the second aperture 408 of the top flange 204 may be spaced approximately 16 inches from each other as measured between the centers of the apertures 404, 408. Similarly, the first aperture 406 of the bottom flange 206 and the second aperture 412 of the bottom flange 206 may also be spaced approximately 16 inches from each other as measured between the centers of the apertures 406, 412. The first aperture 404 of the top flange 204 and the second aperture 408 of the top flange 204 may be larger than the first aperture 406 of the bottom flange 206 and the second aperture 412 of the bottom flange 206.

Although the first aperture 404, the second aperture 408, the first aperture 406, and second aperture 412 are shown to have a substantially circular shape, each of these apertures may have other shapes and dimensions without departing the purpose and use of the apertures described above. Further, although the first aperture 404 and the second aperture 408 of the top flange 204 are shown to be larger than the first aperture 406 and the second aperture 412 of the bottom flange 206, in other embodiments, the apertures 404, 408 in the top flange 206 may be smaller than or the same size as the apertures 406, 412 in the bottom flange 206.

Figure 5:
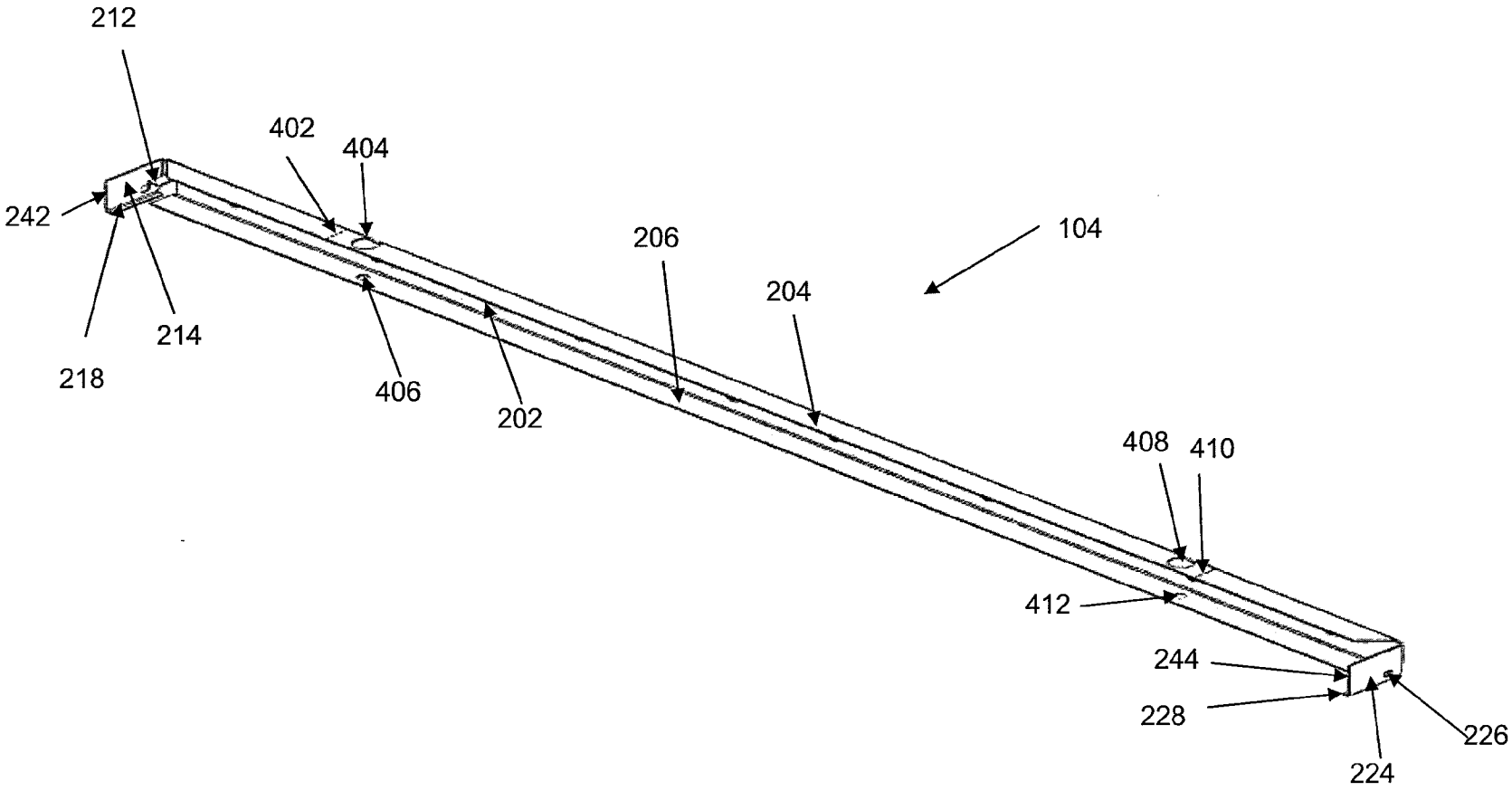
FIG. 5 is an isometric view of the hanger bar of FIG. 2 after a secondary tab at each end of the hanger bar is bent to a second position.

FIG. 5 is an isometric view of the hanger bar 104 with the second tab 214 of the first end portion of the hanger bar 104 and the second tab 224 of the second end portion of the hanger bar 104 bent or folded to illustrate how the hanger 104 is secured on support members, such as the inverted T-bars 112 of FIG. 1. As shown in FIG. 5, the second tab 214 is in a substantially vertical plane that is also substantially perpendicular to the wall 202 of the hanger bar 104. Similarly, the second tab 224 is in a substantially vertical plane that is also substantially perpendicular to the wall 202 of the hanger bar 104. The first tab 212 and the first tab 222 are in the same substantially horizontal plane shown in FIG. 4.

Figure 6:
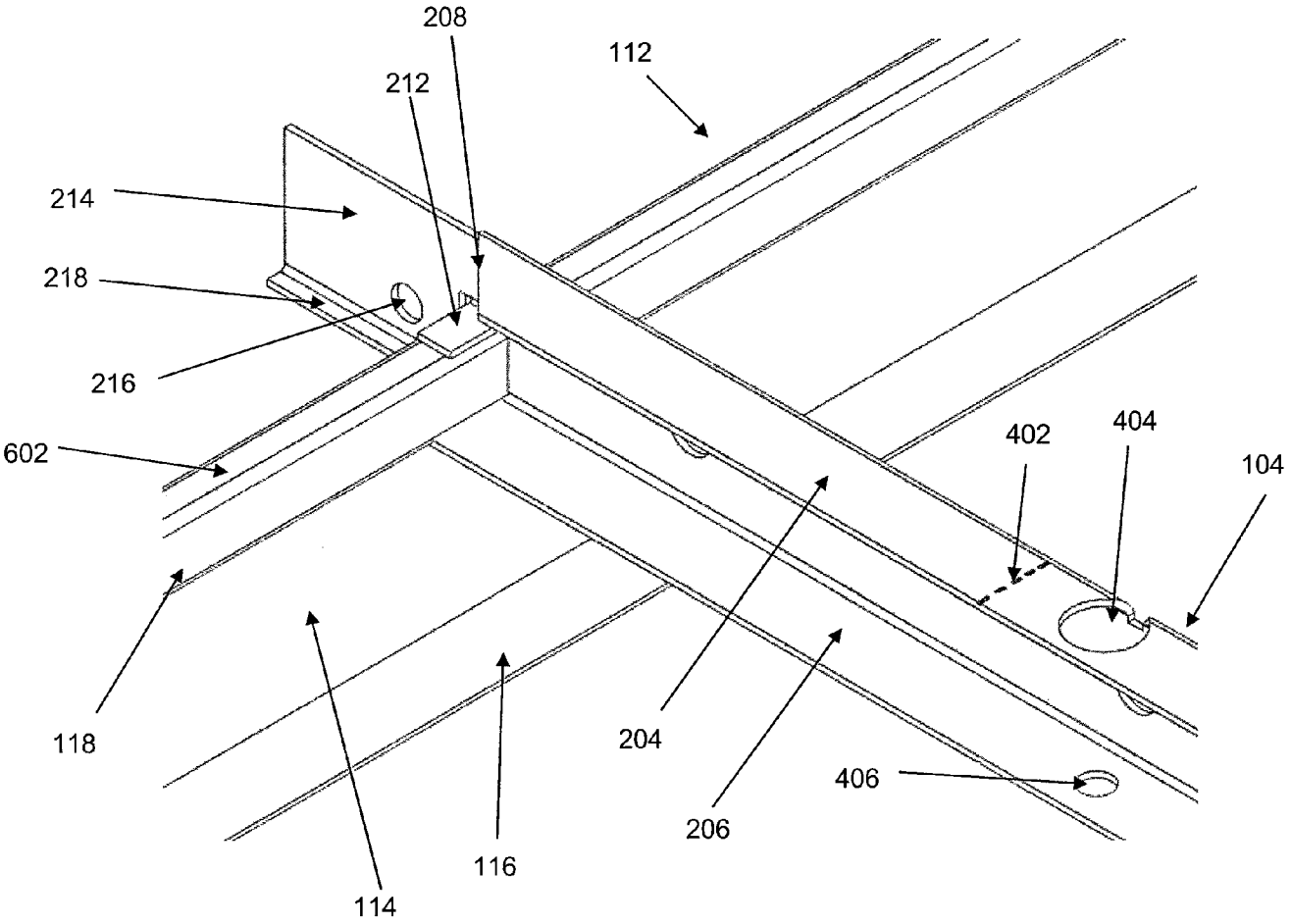
FIG. 6 is a close-up view of a section of the hanger bar of FIG. 2 positioned over an inverted T-bar and prior to bending the second tab into a second position.

FIG. 6 is a close-up view of a section of the hanger bar 104 positioned over the inverted T-bar 112. As shown in FIG. 6, the first tab 212 is positioned over a top surface 602 of the enlarged edge 118 of the inverted T-bar 112. The hanger bar 104 is positioned on the inverted T-bar 112 such that the lip 302 (shown in FIG. 3) fits under enlarged edge 118 on one side of the web 114.

Although FIG. 6 shows one end of the hanger bar 104, the other end of the hanger bar 104 may be similarly positioned over another inverted T-bar 112.

Figure 7:
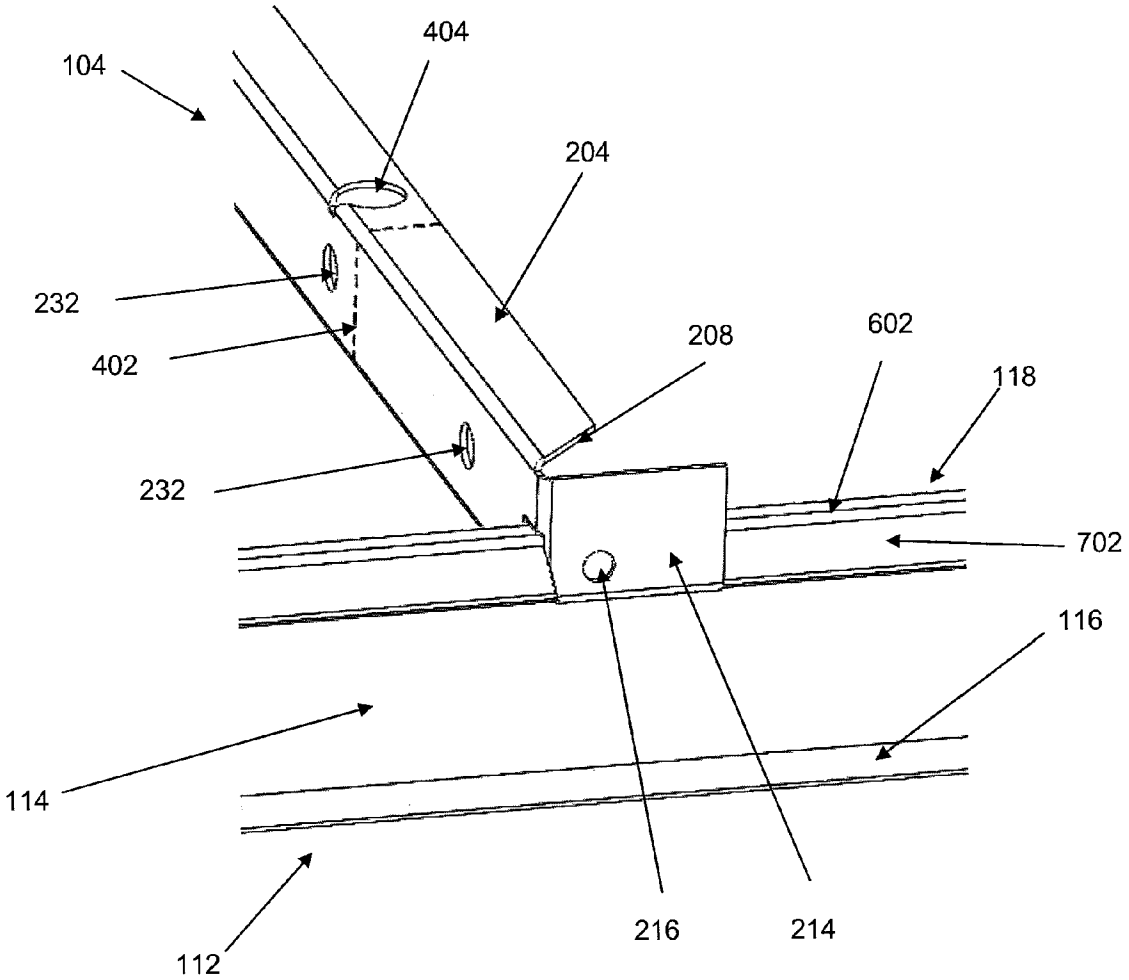
FIG. 7 is a close-up view of the hanger bar of FIG. 2 placed over an inverted T-bar and after bending the second tab into a second position against the inverted T-bar.

FIG. 7 is a close-up view of the section of the hanger bar 104 shown in FIG. 6 after the second tab 214 in bent into a second position. As shown in FIG. 7, the second tab 214 is bent into a position against a side surface 702 of the enlarged edge 118. The flange 218 (shown in FIG. 6) extending from a bottom edge of the second tab 214 may fit under the enlarged edge 118 to help secure the hanger bar 104 to the inverted T-bar 112. For example, the flange 218 may help prevent unintended lifting of the hanger bar 104 from the inverted T-bar 112. The hanger bar 104 may be further secured to the inverted T-bar 112 by a fastener (not shown) that is fastened through aperture 216. For example, a screw may be fastened through the aperture 216 to further secure the hanger bar 112 to the inverted T-bar 112.

Although FIG. 7 shows one end of the hanger bar 104, the other end of the hanger bar 104 may be positioned over another inverted T-bar 112 in the same manner shown in FIG. 7. For example, the second tab 224 shown in FIG. 2 may be bent into a similar position as the second tab 214 that is shown in FIG. 7.

As illustrated in FIGS. 6 and 7, the hanger bar 104 may be quickly installed on inverted T-bars 112 by positioning the hanger bar 104 on the inverted T-bars 112 and bending or folding each second tab 214, 224 into a position that engages the corresponding T-bar 112. Each second tab 214, 224 may be further secured by fastening a fastener through the aperture 216, 226, respectively.

Figure 8:
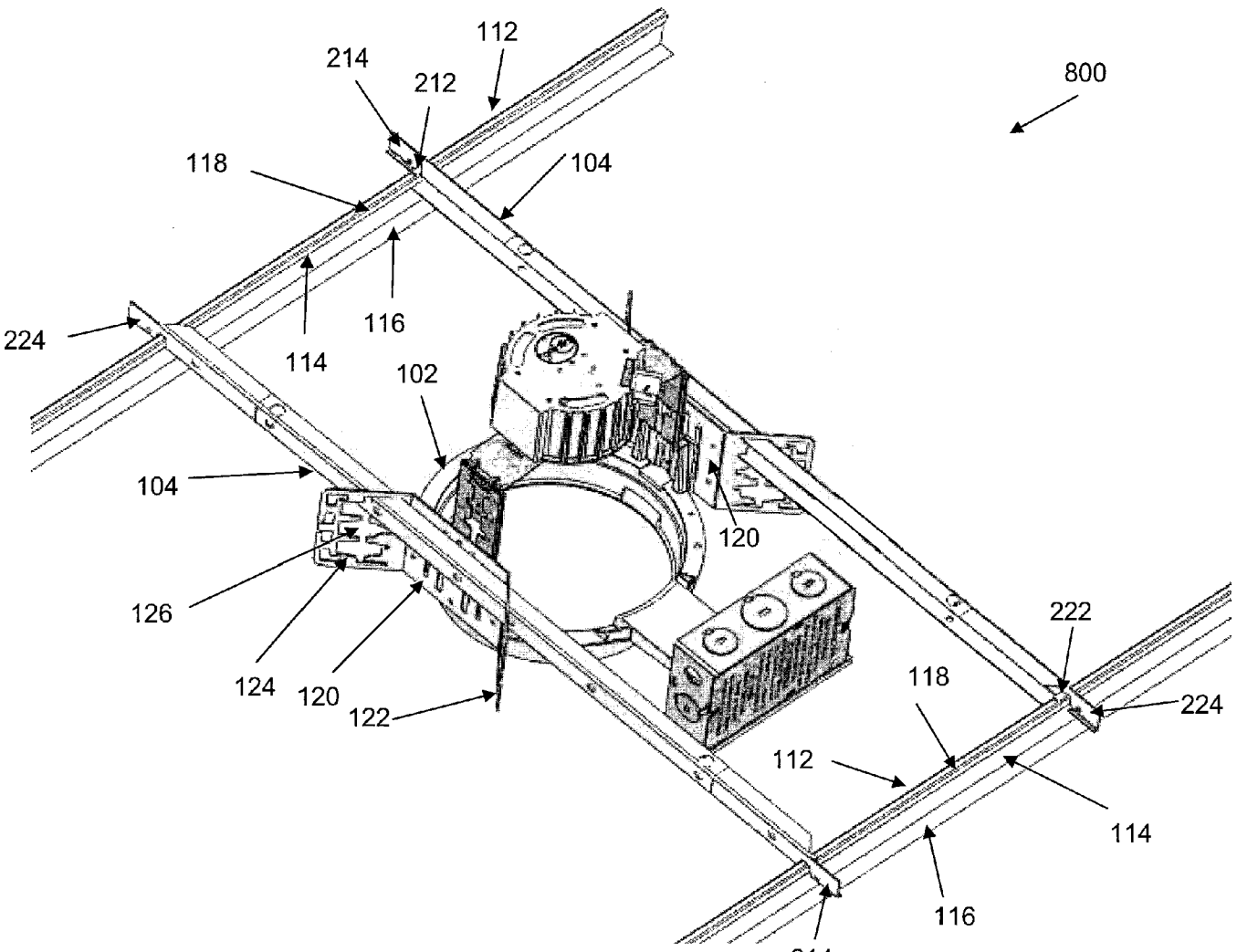
FIG. 8 illustrates the exemplary structure of FIG. 1 before secondary tabs of each hanger bar are bent into a second position.

FIG. 8 illustrates an exemplary structure 800 that includes the recessed lighting fixture 102 and the hanger bars 104 prior to bending the second tab 214, 224 of each hanger bar 104 to secure the hanger bars 104 to the inverted T-bars 112 as shown in FIG. 1. As shown in FIG. 8, each hanger bar 104 rests on two spaced inverted T-bars 112 that are parallel to each other. The first tab 212 of the first end portion of each hanger bar 104 is positioned on the enlarged edge 118 of the inverted T-bars 112 through the notch 220 or 230. Similarly, the first tab 222 of the second end portion of each hanger bar 104 rests on the enlarged edge 118 of the inverted T-bars 112 through the notch 220 or 230. A close-up view of the placement of one end of the hanger bar 104 over the inverted T-bar 112 is shown in FIG. 6.

As illustrated in FIGS. 1, 6, 7, and 8, installation of the hanger bars 104 over inverted T-bars 112 may be performed by positioning the hanger bars 104 over the inverted T-bars 112, where the primary tabs 212, 222 of each hanger bar 104 rest on respective T-bars through respective notches 220, 230 of each hanger bar 104. Subsequent to positioning the hanger bars 104 over the inverted T-bars 112, the hanger bars 104 may be secured to the inverted T-bars 112 by bending the secondary tabs 214, 224 of each hanger bar 104 in the positions illustrated in FIGS. 1 and 7. The hanger bars 104 may further be secured to the inverted T-bars 112 by fastening a fastener through aperture 216, 226 of the respective secondary tabs 214, 224. The recessed lighting fixture 102 is installed between the hanger bars 104 prior to securing the hanger bars 104 to the inverted T-bars 112 by bending the secondary tabs 214, 224.

Figure 9:
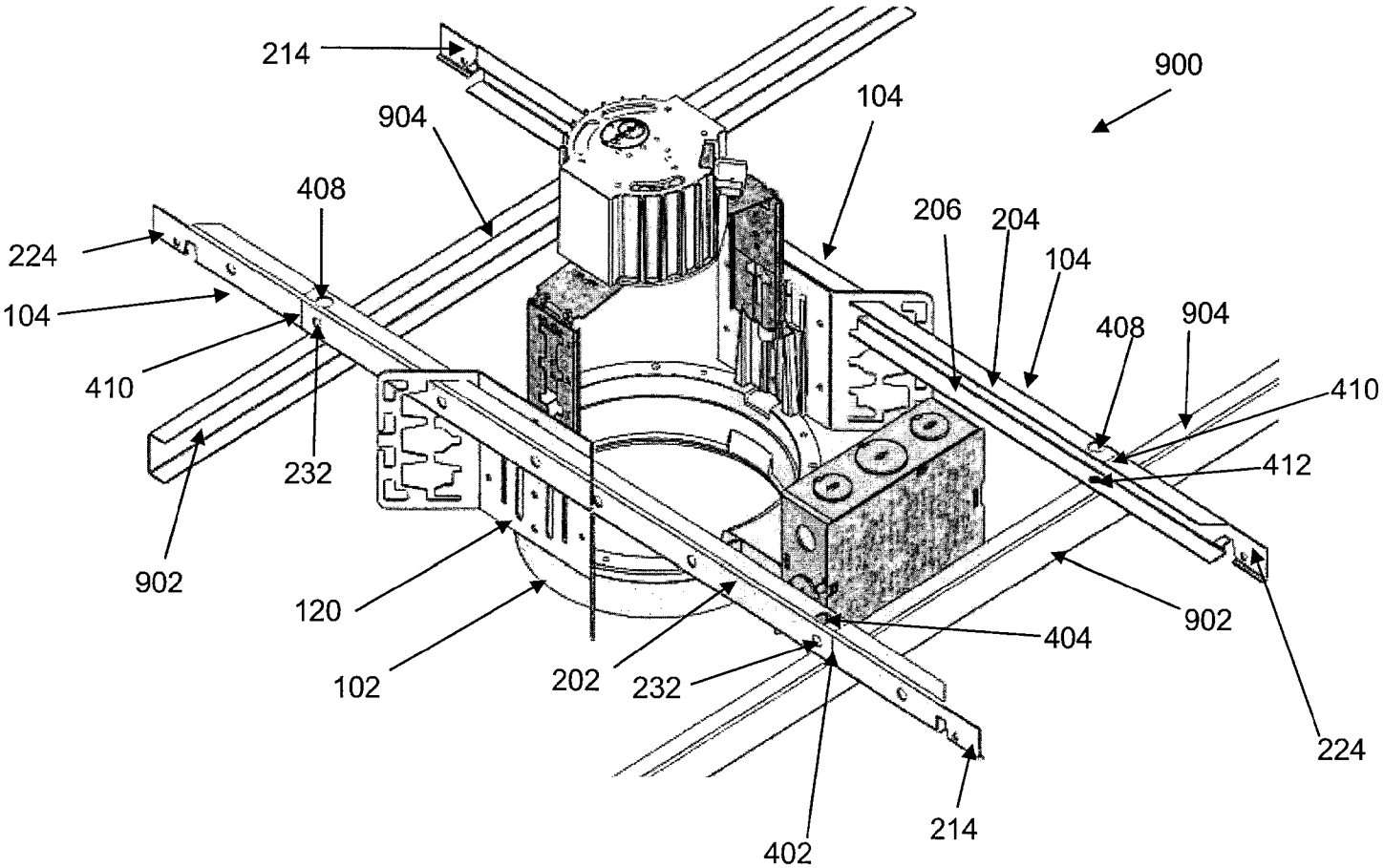
FIG. 9 is an exemplary structure that includes the recessed lighting fixture installed between the hanger bars.

FIG. 9 illustrates an exemplary structure 900 including the recessed lighting fixture 102 installed between the hanger bars 104. Each hanger bar 104 rests, at each end, on horizontal joists 902 that are parallel to each other. For example, each hanger bar 104 may rest on a top surface 904 of the joists 902. The joists 902 are spaced from each other approximately the same distance as the distance between the first aperture 404 and the second aperture 408 of each hanger bar 104. The first aperture 406 (shown in FIG. 4) in the bottom flange 206 of each hanger bar 104 and the second aperture 412 in the bottom flange 206 of each hanger bar 104 are positioned over a different one of the joists 902. Similarly, the first aperture 404 in the top flange 204 of each hanger bar 104 and the second aperture 408 in the top flange 204 of each hanger bar 104 are positioned over a different one of the joists 902. The apertures 232 in the wall 202 of each hanger bar 104 may be used to align the hanger bars 104 to each other over the joists 902.

After the hanger bars 104 are positioned on the joists 902 such that the first aperture 406 and the second aperture 412 of each hanger bar 104 are positioned over the joist 902, a fastener such as a screw may be used to fasten the hanger bars 104 to the joists 902. For example, a screw may be used to fasten hanger bars 104 to the joists by fastening the screw through the first aperture 406 and the second aperture 412. A fastening tool, such as a screw driver or a drill, may be partially inserted through the first aperture 404 in the top flange 204 each hanger bar 104 to fasten the screw through the first aperture 406 (shown in FIG. 4) of the bottom flange 204 of each hanger bar 104. Similarly, a drill or a screw driver may be partially inserted through the second aperture 408 in the top flange 204 of each hanger bar 104 to fasten a screw through the second aperture 412 of the bottom to the flange 204 of each hanger bar 104.

As shown in FIG. 9, the score lines 402, 404 may extend slightly beyond the joists 902. After the hanger bars 104 are secured to the joists 902, the hanger bars 104 may be broken or cut along the score lines 402, 410 to shorten the length of the hanger bar 104. In an alternative embodiment, the hanger bars 104 may be shortened prior to securing the hanger bars 104 to the joists 902.

Although the joists 902 are shown in FIG. 9 as the support members, in other embodiments, the hanger bars 104 may rest on other kinds of support members. The hanger bars 104 may also be attached to support members that are neither horizontal nor parallel. Further, the hanger bars 104 may be used with a variety of receivers that are different from the hanger bar receivers 120. The hanger bars 104 may also be used with a variety of recessed and non-recessed lighting as well as other devices.

Figure 10:
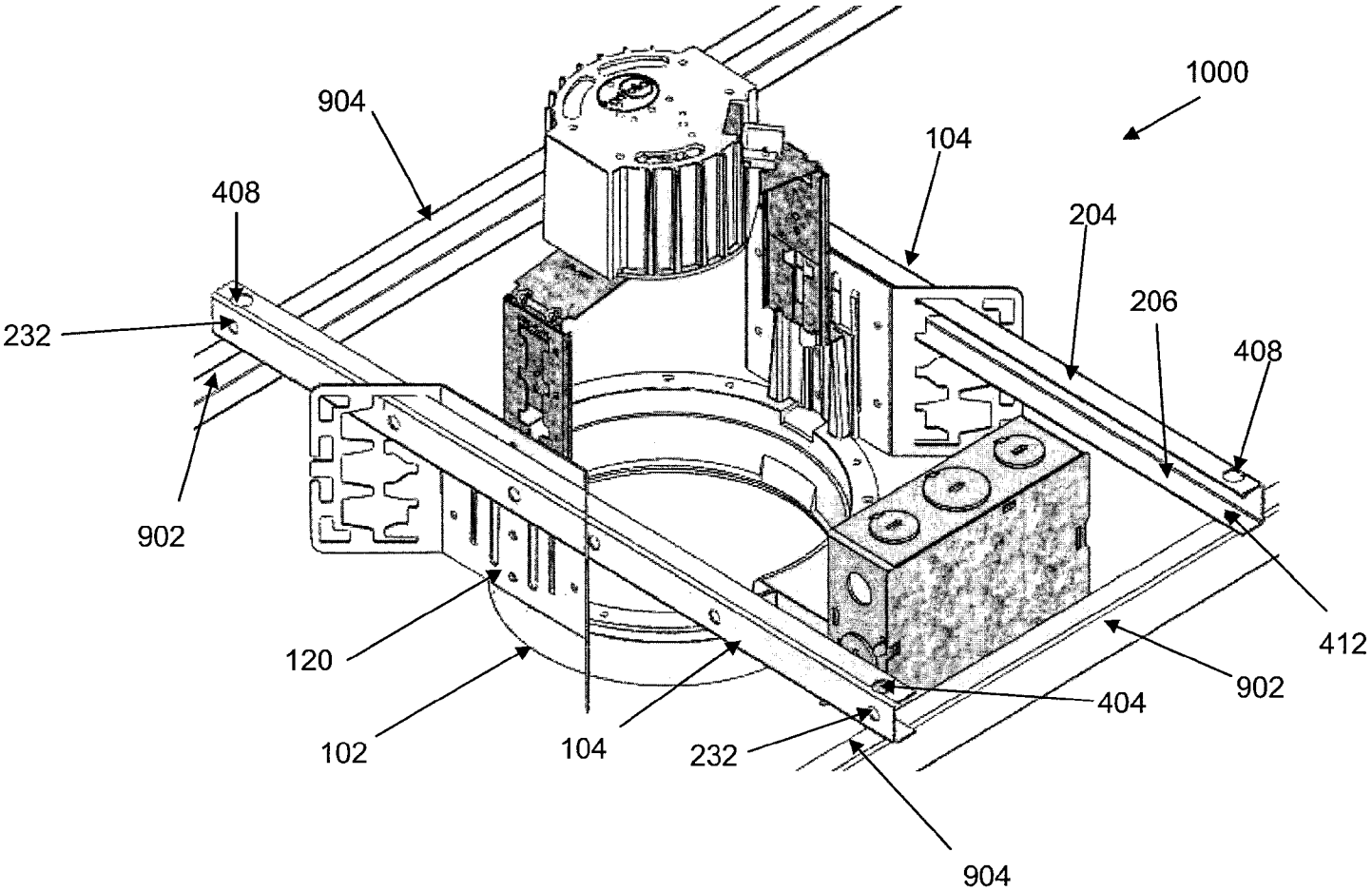
FIG. 10 is an exemplary structure that includes the recessed lighting fixture and the hanger bars after each hanger bar is shortened in length.

FIG. 10 illustrates an exemplary structure 1000 that includes the recessed lighting fixture 102 and the hanger bars 104 after the hanger bars 104 are shortened in length. Each hanger bar 104 is shortened by cutting or breaking the hanger bar 104 at the score lines 402 and 410. As described with respect to FIG. 9, each hanger bar 104 may be secured to the joists 902 by fastening a fastener (e.g., a screw) through the first aperture 406 (shown in FIG. 4) and the second aperture 412 in the bottom flange 206 of each hanger bar 104.

As illustrated in FIGS. 9 and 10, installation of the hanger bars 104 over joists 902 may be performed by positioning the hanger bars 104 over the inverted T-bars 112, where the first apertures 404, 406 and the second apertures 408, 412 of each hanger bar 104 are positioned over respective joists 902. The hanger bars 104 my be secured to the joists 902 by fastening a fastener through the first aperture 406 and the second aperture 412 of the bottom flange of each hanger bar 104. The hanger bars 104 may be shortened in length by cutting off or breaking, at score lines 402, 410, a portion of the hanger bars 104 that extend beyond the joists 902. The recessed lighting fixture 102 is installed between the hanger bars 104 prior to securing the hanger bars 104 to the inverted T-bars 112 by fastening a fastener (e.g., a screw) through the first aperture 406 and the second aperture 412.

Figure 11:
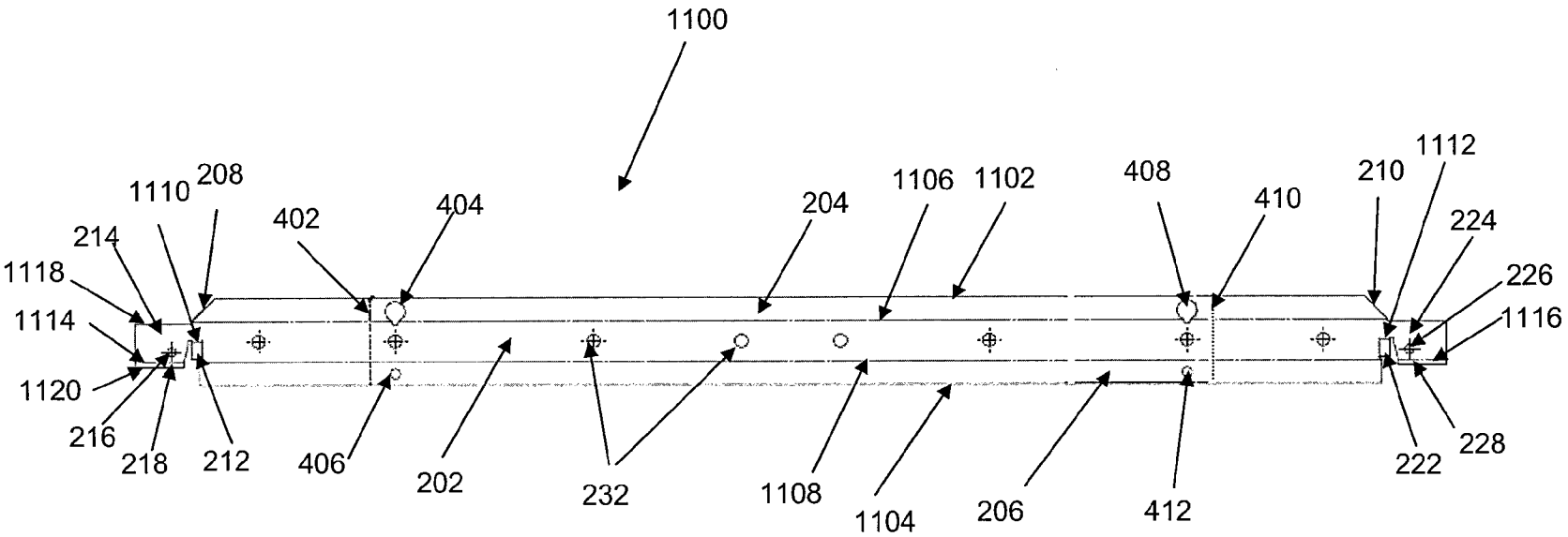
FIG. 11 is an illustrative frontal view of an unshaped hanger bar, prior to bending a top flange, a bottom flange, and first tabs to produce the hanger bar shown in FIG. 2.

FIG. 11 is an illustrative frontal view of an unshaped hanger bar 1100 prior to bending the top flange 204, the bottom flange 206, and the first tabs 212, 222 resulting in the hanger bar 104 shown in FIG. 2. The unshaped hanger bar 1100 includes the same feature as the hanger bar 104. To produce the hanger bar 104 of FIG. 2, the top flange 204 and the bottom flange 206 are bent into substantially horizontal positions on the same side of the wall 202. The top flange 204 is bent along a line 1106 into a position that is substantially perpendicular to the wall 202. The bottom flange 206 is bent along a line 1108 into a position that is also substantially perpendicular to the wall 202. When the unshaped hanger bar 1100 is oriented as shown in FIG. 11, the top flange 204 may be bent downwards and the bottom flange 206 may be bent upwards into the positions of the top flange 204 and the bottom flange 206 shown, for example, in FIG. 2.

The first tab 212 and the first tab 222 are also bent into positions shown, for example, in FIGS. 2 and 4. The first tab 212 proximal to a first end of the unshaped hanger bar 1100 is bent along a line 1110, and the first tab 222 proximal to a second end of the unshaped hanger bar 1100 is bent along a line 1112.

The flange 218 may be bent along a line 1114 and the flange 228 may be bent along a line 1116 into the positions shown, for example, in FIGS. 2 and 4. When the unshaped hanger bar 1100 is oriented as shown in FIG. 11, the flanges 218, 228 may be bent upwards such that the flanges 218, 228 are substantially perpendicular to the wall of their respective secondary tabs 214, 224.

In a particular embodiment, the distance between a first edge 1102 and a second edge 1104 may be approximately 1.73 inches, the distance between a first edge 1102 and the line 1106 may be approximately 0.5 inches, and the distance between a first edge 1118 and a second edge 1120 may be approximately 0.877 inches. Each first tab 212, 222 may have a vertical length of approximately 0.375 inches.

It should be emphasized that the embodiments described above, including dimensions, are merely examples of various implementations that have been set forth here to provide a clear understanding of various aspects of the disclosure. Those skilled in the art will appreciate that the exemplary embodiments described herein are not limited to any specifically discussed application and that the embodiments described herein are illustrative and not restrictive. It should be appreciated by those skilled in the art that various modifications are well within the scope and spirit of this disclosure. Therefore, other embodiments are intended to be included within the scope of this application. Although specific terms are employed herein, they are used in a generic and descriptive sense only and not for purposes of limitation.

What is claimed is:

1. A hanger bar comprising:
- a rail portion having a wall in a first plane;
- a first end portion disposed at a first end of the rail portion; and
- a second end portion disposed at a second end of the rail portion, each of the first end portion and the second end portion comprising:
  - a first tab extending from the rail portion in a second plane that is substantially perpendicular to the first plane; and
  - a second tab extending from the rail portion, the second tab extending beyond the first tab, wherein the second tab is in substantially the first plane; and
  - a notch that is substantially below the first tab, wherein the notch is partially bounded by an edge of the second tab, wherein the first plane is a substantially vertical plane and wherein the second plane is a substantially horizontal plane when the hanger bar is attached to a horizontal support member.

2. The hanger bar of claim 1, wherein the first tab of the first end portion is positioned between a first edge of the rail portion and the edge of the second tab of the first end portion, and wherein the first tab of the second end portion is positioned between a second edge of the rail portion and the edge of the second tab of the second end portion.

3. The hanger bar of claim 1, wherein the second tab is bendable to a position that is substantially perpendicular to the wall of the rail portion.

4. The hanger bar of claim 1, wherein the first tab of the first end portion is configured to rest on an enlarged edge of a first inverted T-bar, wherein the enlarged edge of the first inverted T-bar is positioned in the notch of the first end portion, wherein the first tab of the second end portion is configured to rest on an enlarged edge of a second inverted T-bar, and wherein the enlarged edge of the second inverted T-bar is positioned in the notch of the second end portion.

5. The hanger bar of claim 1, wherein the rail portion further comprises:
- a top flange extending from a top edge of the wall of the rail portion; and
- a bottom flange extending from a bottom edge of the wall of the rail portion.

6. The hanger bar of claim 5, wherein the bottom flange comprises a first aperture configured to receive a fastener, wherein the top flange comprises a second aperture configured to allow a portion a fastening tool to pass through the second aperture to fasten the fastener through the first aperture.

7. The hanger bar of claim 6, wherein the rail portion further comprises a score line between the second aperture of the top flange and a first end of the top flange, wherein the score line allows shortening of the rail portion by cutting at the score line.

8. The hanger bar of claim 1, wherein the second tab of each of the first end portion and the second end portion comprises an aperture to receive a fastener to securely attach the second tab to a corresponding inverted T-bar.

9. The hanger bar of claim 1, wherein each of the second tab of the first end portion and the second tab of the second end portion comprises a bottom flange configured to engage a bottom surface of an enlarged top edge of an inverted T-bar.

10. A hanger bar assembly comprising:
- a first hanger bar; and
- a second hanger bar;
- a lighting fixture supported by the first hanger bar and the second hanger bar, wherein each of the first hanger bar and the second hanger bar comprises:
  - a rail portion having a wall in a first plane;
  - a first end portion disposed at a first end of the rail portion; and
  - a second end portion disposed at a second end of the rail portion, each of the first end portion and the second end portion comprising:
    - a first tab extending from the rail portion in a second plane that is substantially perpendicular to the first plane; and
    - a second tab extending from the rail portion, the second tab extending beyond the first tab; and
    - a notch that is substantially below the first tab, wherein the notch is partially bounded by an edge of the second tab, wherein the second tab of each of the first end portion and the second end portion is in substantially the first plane and wherein the first plane is a vertical plane, and wherein the second plane is a substantially horizontal plane.

11. The hanger bar assembly of claim 10, wherein the second tab is bendable to a position that is substantially perpendicular to the wall of the rail portion.

12. The hanger bar assembly of claim 10, wherein the first tab of the first end portion of each of the first hanger bar and the second hanger bar is positioned between a first edge of the rail portion and the edge of the second tab of the first end portion, and wherein the first tab of the second end portion of each of the first hanger bar and the second hanger bar is positioned between a second edge of the rail portion and the edge of the second tab of the second end portion.

13. The hanger bar assembly of claim 10, wherein the first tab of the first end portion of the first hanger bar and the first tab of the second end portion of the second hanger bar are positioned on an enlarged edge of a first inverted T-bar, wherein the first tab of the second end portion of the first hanger bar and the first tab of the first end portion of the second hanger bar are positioned on an enlarged edge of a second inverted T-bar.

14. The hanger bar assembly of claim 13, wherein the rail portion of each of the first hanger bar and the second hanger bar comprises a bottom flange extending from a bottom edge of the wall of the rail portion, wherein the bottom flange is substantially perpendicular to the wall of the rail portion, and wherein a lip of the bottom flange is configured to engage a bottom surface of an enlarged top edge of a corresponding inverted T-bar.

15. The hanger bar assembly of claim 10, wherein each second tab comprises a bottom flange configured to engage a bottom surface of an enlarged top edge of an inverted T-bar.

16. A hanger bar comprising:

a rail portion having a wall in a first plane;

a first end portion disposed at a first end of the rail portion; and a second end portion disposed at a second end of the rail portion, each of the first end portion and the second end portion comprising:

a first tab extending from the rail portion in a second plane that is substantially perpendicular to the first plane; and a second tab extending from the rail portion, the second tab extending beyond the first tab; and a notch that is substantially below the first tab, wherein the notch is partially bounded by an edge of the second tab, wherein the rail portion further comprises:

a top flange extending from a top edge of the wall of the rail portion; and a bottom flange extending from a bottom edge of the wall of the rail portion, wherein the bottom flange comprises a first aperture configured to receive a fastener, wherein the top flange comprises a second aperture configured to allow a portion a fastening tool to pass through the second aperture to fasten the fastener through the first aperture.

17. The hanger bar of claim 16, wherein the rail portion further comprises a score line between the second aperture of the top flange and a first end of the top flange, wherein the score line allows shortening of the rail portion by cutting at the score line.

* * * * *